US011317178B2

(12) United States Patent
Allison

(10) Patent No.: US 11,317,178 B2
(45) Date of Patent: Apr. 26, 2022

(54) LOW-FREQUENCY SPIRAL WAVEGUIDE SPEAKER

(71) Applicant: Clay Allison, Evansville, IN (US)

(72) Inventor: Clay Allison, Evansville, IN (US)

( * ) Notice: Subject to any disclaimer, the term of this patent is extended or adjusted under 35 U.S.C. 154(b) by 43 days.

(21) Appl. No.: 16/924,865

(22) Filed: Jul. 9, 2020

(65) Prior Publication Data

US 2021/0014586 A1 Jan. 14, 2021

Related U.S. Application Data

(60) Provisional application No. 62/873,553, filed on Jul. 12, 2019.

(51) Int. Cl.
*H04R 1/02* (2006.01)

(52) U.S. Cl.
CPC ..... *H04R 1/02* (2013.01)

(58) Field of Classification Search
CPC ..... H04R 1/02; H04R 1/34; H04R 1/2803; H04R 1/2853; H04R 1/2857; H04R 1/2819; H04R 1/2826; H04R 1/30; H04R 2205/021; G10K 11/02
USPC ..... 381/339, 340, 341, 338, 332, 334, 336, 381/173, 191, 190, 156, 386; 181/193, 181/199, 198, 148, 156, 279, 163, 155, 181/160, 175
See application file for complete search history.

(56) References Cited

U.S. PATENT DOCUMENTS 5,751,827 A * 5/1998 Takahashi ..... H04R 17/00 381/173
6,278,789 B1 * 8/2001 Potter ..... H04R 1/2857 181/151
6,648,098 B2 * 11/2003 Nichols ..... H04R 1/2857 181/182
2002/0085731 A1 * 7/2002 Aylward ..... H04R 1/2857 381/349
2009/0084624 A1 * 4/2009 Dickie ..... H04R 1/2819 181/152
2010/0183179 A1 * 7/2010 Griffin, Jr. ..... H04R 1/30 381/337
2013/0034255 A1 * 2/2013 Parker ..... H04R 1/2857 381/338
2015/0382103 A1 * 12/2015 Powell ..... H04R 1/2803 381/338

* cited by examiner

*Primary Examiner* — Alexander Krzystan
*Assistant Examiner* — Julie X Dang
(74) *Attorney, Agent, or Firm* — Martin IP Law Group; C. Richard Martin

(57) ABSTRACT

A low-frequency loudspeaker is provided comprising an enclosure having a front, a back and a sidewall. An audio speaker is mounted in an opening in the front of the enclosure. The audio speaker has a diaphragm for producing front sound waves that are transmitted outwardly from the diaphragm and back sound waves that are transmitted into the enclosure from the diaphragm. A spiral waveguide is positioned within the enclosure. The spiral waveguide has a first end proximal to the speaker diaphragm for receiving the back sound waves and extends outwardly therefrom in a spiral pattern to a second end that forms a low-frequency terminus exit port opening in the sidewall.

16 Claims, 11 Drawing Sheets

LOW-FREQUENCY SPIRAL WAVEGUIDE SPEAKER

BACKGROUND OF THE INVENTION

Field of the Invention

The present invention relates to the reproduction of sound in the low frequency region. More specifically, a more compact method of constructing what is commonly referred to as a transmission line loudspeaker.

Description of the Related Art

With the advent of wireless technologies such as Bluetooth, there has been a marked increase in the use of portable, wireless speakers for a variety of uses. However, the sound quality of many of these speaker systems, particularly in the low-frequency range, leaves much to be desired. Traditional subwoofers that are designed to produce sound in the low frequency range require large-coned speakers and/or large heavy boxes to achieve the desired low frequencies. Thus, in order to achieve high-qualify low-frequency sound, a large and heavy speaker system is often required.

Accordingly, there is a need for a light-weight, compact, portable speaker system that does not sacrifice sound quality in the low-frequency range.

SUMMARY OF THE INVENTION

It is therefore an object of the present invention to provide a light-weight, compact and portable speaker system that has good-sound quality by minimizing the deleterious effects of group delay.

The present invention meets these objects by providing a low-frequency spiral waveguide within a portable speaker system. This new method shares the superior sonic qualities of a traditionally constructed transmission line speakers, while providing additional benefits, creating a new category of loudspeaker enclosure offering a compact form with improved sonic characteristics.

The spiral waveguide provides a constant redirecting of the soundwave without abrupt changes in direction, unlike typical 90 deg or 180 degree folded lines, which create turbulence. The spiral waveguide therefore provides a line with a much longer effective acoustic length and minimum pressure attenuation. The result is a compact enclosure for a low-frequency transducer that provides greater efficiency as compared to a sealed box design while retaining its superior time domain characteristics and by a reduction in back EMF (an undesirable by-product present in all moving coil transducers.)

Due to the compact nature of the spiral waveguide and its high taper ratio, the cabinet volume is greatly reduced, making it comparable in size to many loudspeaker enclosures. Thinner materials can be used for the largest side panels due to the inner spiral's bracing effect, directly tying together these panels and reducing the unwanted resonances caused by excitation pressures within the enclosure. This design shares the shallow low frequency roll-off rate of a sealed-box design providing excellent time domain characteristics, by not introducing excessive group delay, and avoiding its detrimental effects. This design achieves increased efficiency and extended low frequency output along with reduced cone motion at the tuning frequency, similar to ported speakers, however the damaging effects of infrasonic cone motion are minimized due to the flow-resistive nature of the spiral in comparison to a typically straight port tube.

According to one presently preferred embodiment of the invention, there is provided a low-frequency loudspeaker comprising an enclosure having a front, a back and a sidewall. An audio speaker is mounted in an opening in the front of the enclosure. The audio speaker has a diaphragm for producing front sound waves that are transmitted outwardly from the diaphragm and back sound waves that are transmitted into the enclosure from the diaphragm. A spiral waveguide is positioned within the enclosure. The spiral waveguide has a first end proximal to the speaker diaphragm for receiving the back sound waves and extends outwardly therefrom in a spiral pattern to a second end that forms a low-frequency terminus exit port opening in the sidewall.

The low-frequency loudspeaker may further comprise one or more (a plurality) speakers mounted in a corresponding one or more openings in a front-facing section of said sidewall. The low-frequency terminus exit port may be located in a rear-facing section of the sidewall, and may flared to provide a smooth transition from high pressure sound waves to a listening room at a dissimilar acoustic impedance.

The spiral waveguide may extend from and tie together the front and back of the enclosure to control undesirable large panel resonances caused by excitation pressure within. Damping material may be applied to an outer face of the spiral waveguide. Further, fibrous damping material may be located in the enclosure to provide acoustic viscosity which helps control infrasonic cone motion and further increases the effective length of the waveguide.

The spacing at the first end of the spiral waveguide may be sized to correspond with the surface area of the diaphragm of the low-frequency speaker. The internal distance between the front and back of the enclosure is preferrably equal to +/−20% of the diameter of a piston of the low-frequency speaker.

The spiral waveguide preferably begins with a relatively wide area between the first end and the next winding and narrows as the winding of the waveguide progresses such that there is a relatively narrow area at the exit port.

According to an alternative embodiment, a pair of audio speakers may be mounted adjacent to one another in openings in the front of the enclosure. Further, according to this embodiment, the spiral waveguide comprises a full length primary spiral waveguide and a shorter, secondary waveguide interposed between windings of the primary spiral waveguide.

According to yet another embodiment of the invention, one or more additional speakers may be mounted in a corresponding one or more openings in the front of the speaker. The spiral waveguide in this embodiment may also acts as the sidewall of the enclosure. The enclosure according to this embodiment may be substantially egg-shaped. The egg-shaped enclosure may be offset from an upright position resulting in a longer waveguide thereby reducing the tuning frequency which also improved speaker performance. The egg-shaped enclosure may preferably be offset by 45 degrees.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which.

DETAILED DESCRIPTION OF THE INVENTION

Figure 1:
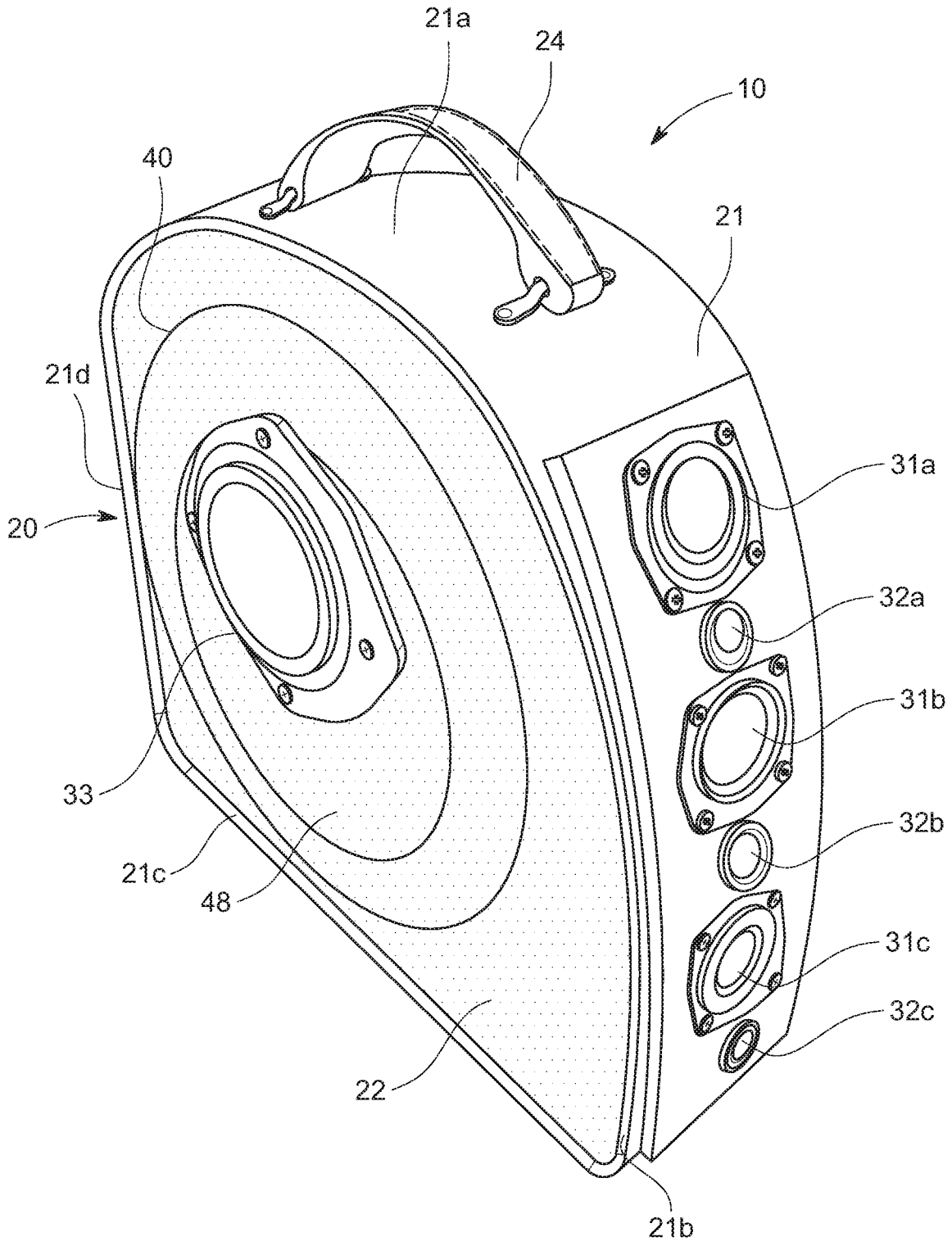
FIG. 1 is a perspective view of a speaker system having a low-frequency spiral waveguide according to one preferred embodiment of the invention.
Figure 2:
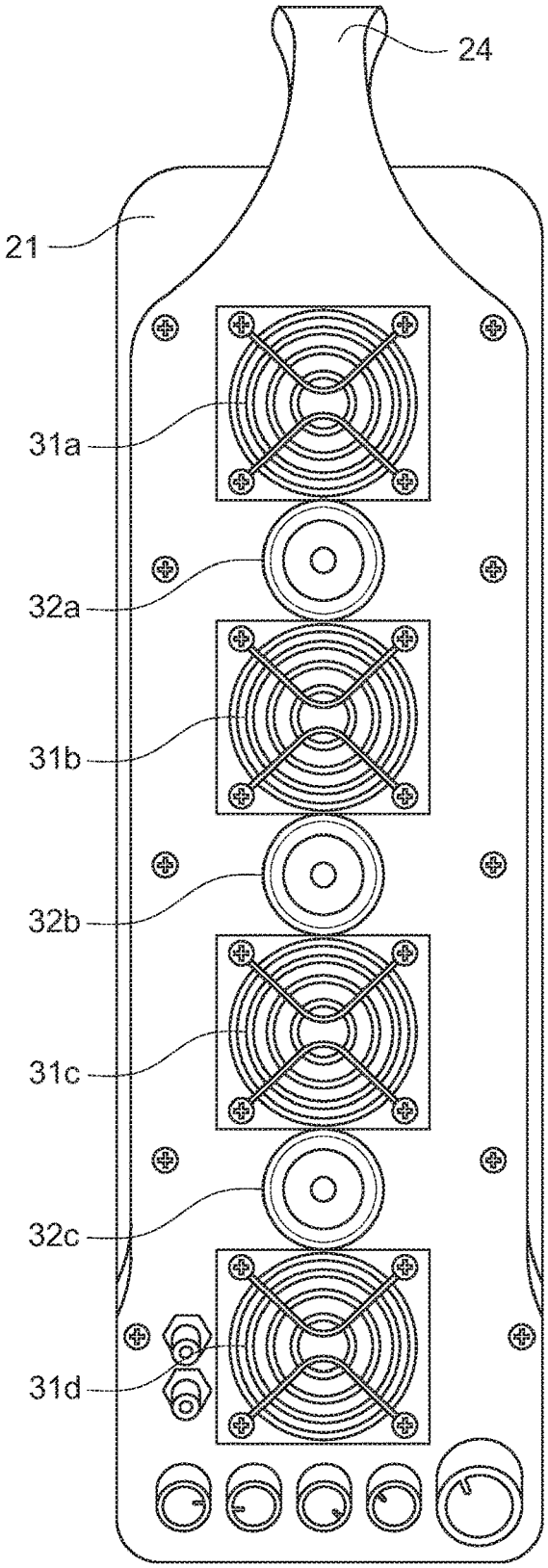
FIG. 2 is a front plan view of the speaker system shown in FIG. 1.
Figure 3:
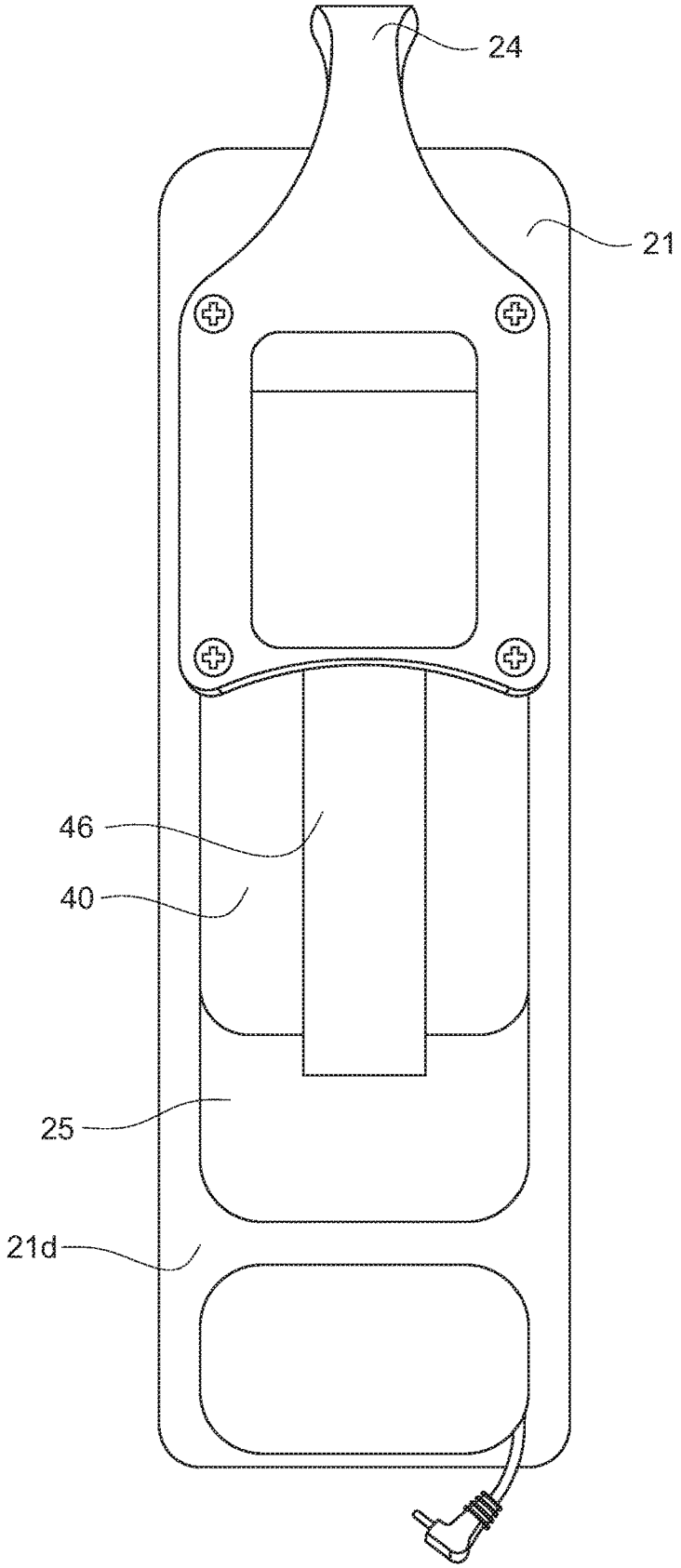
FIG. 3 is a rear plan view of the speaker system shown in FIG. 1.
Figure 4:
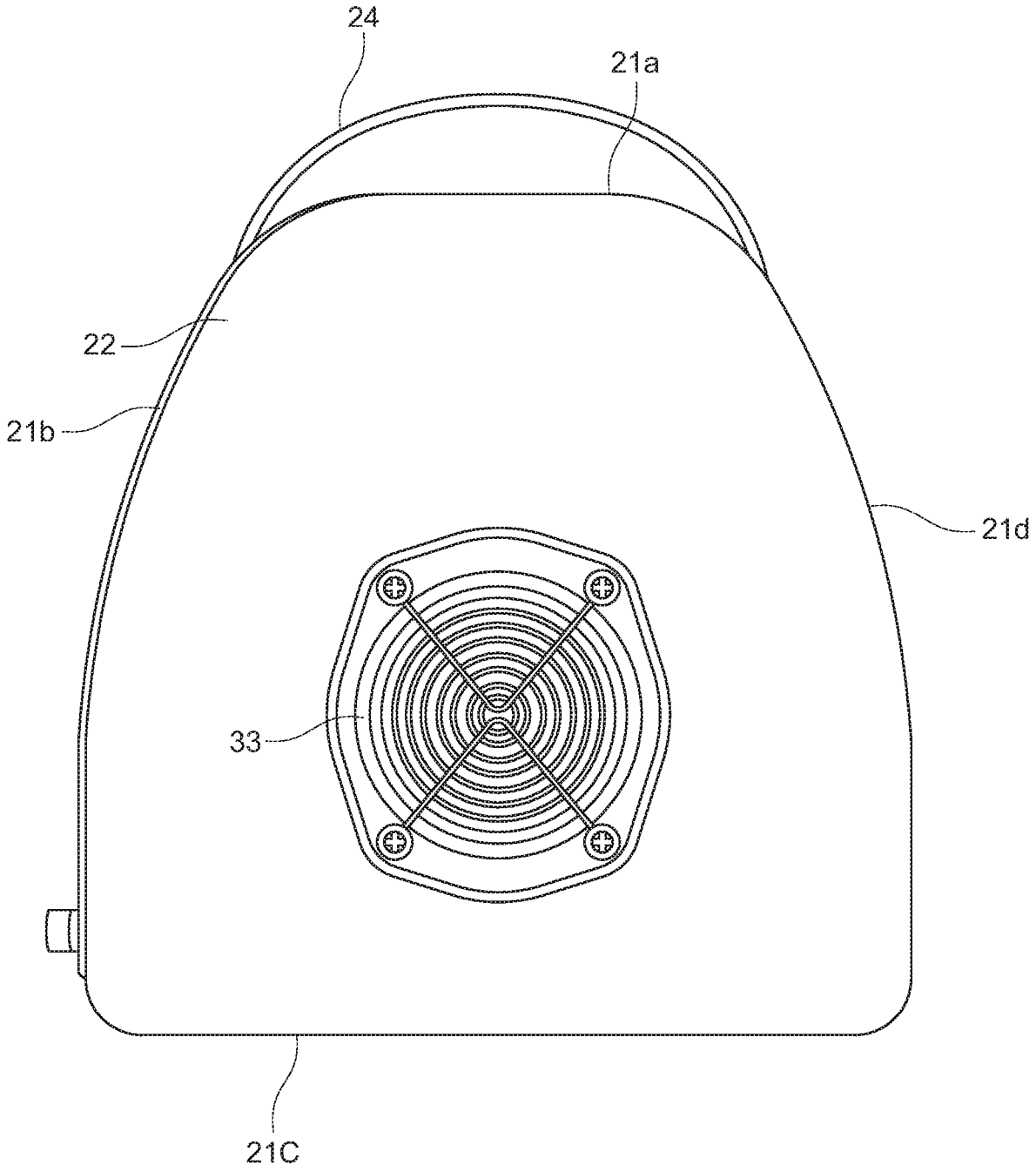
FIG. 4 is a side plan view of the speaker system shown in FIG. 1.
Figure 5:
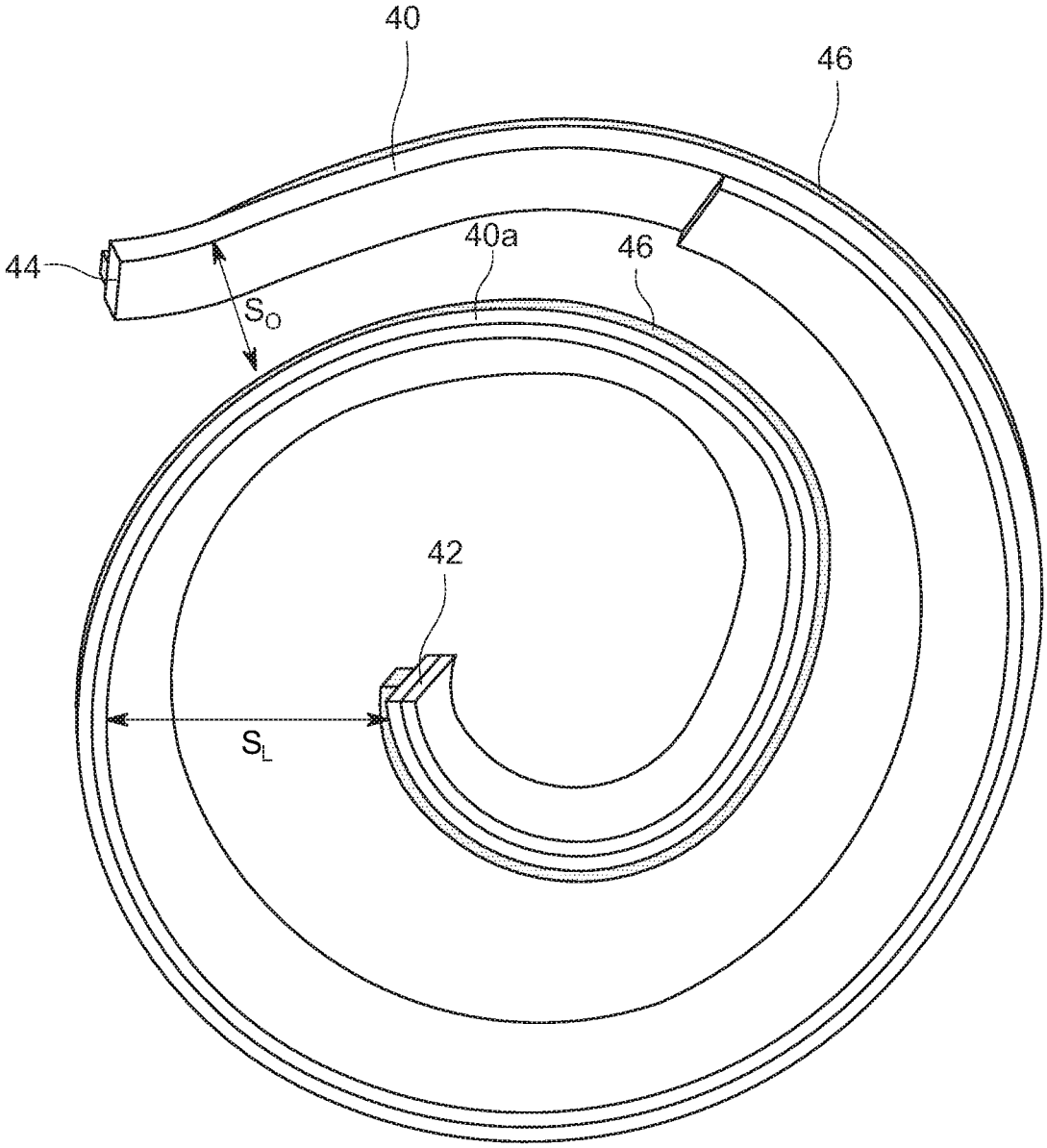
FIG. 5 is a side plan view of the spiral waveguide of the speaker system shown in FIG. 1.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

As best shown in FIG. 1-FIG. 6, one presently preferred embodiment of the invention comprises a speaker system 10 having a housing 20 which includes a curved sidewall 21 and flat end panels 22, 23. A handle 24 may be provided on a top region 21*a* of the sidewall 21 to allow the speaker 10 to be easily transported. A front region 21*b* of the sidewall may include a speaker array 30 that may include one or more speakers 31*a*, 31*b*, 31*c*, 32*a*, 32*b*, 32*c*. A bottom region 21*c* of the sidewall 21 is configured to rest on a stable surface such as the floor. A rear region 21*d* of the sidewall includes an exit port 25 that serves as a vent for the speaker system 10 and a method to expel heat generated by the electronics that share its cavity. The flared exit port 25 provides a smooth transition from high pressure sound waves to a listening room at a dissimilar acoustic impedance.

Located within the speaker system 10 is a spiral waveguide 40, the width of which spans the space between the end panels 22, 23. The spiral waveguide 40 directly ties together the end panels 22, 23 thereby controlling undesirable large panel resonances caused by excitation pressure within. The spiral waveguide 40 includes a first end 42 located near the center of the speaker system 10 and spirals outwardly to a second end 44 which, along with an interior portion of the waveguide wall, forms the low-frequency terminus exit port 25 in the rear region 21*d* of the sidewall 21. Damping material 46, such as open cell foam rubber, may be applied to an outer face 40*a* of the spiral waveguide 40 thereby adding to the effective length by increasing friction of the air mass in the sound wave. In addition, fibrous damping material 48 may be used in the coupling chamber of the speaker system 10 to provide acoustic viscosity which helps control infrasonic cone motion and further increases the effective length of the waveguide 40.

A low-frequency speaker (subwoofer) 33 is provided in an opening located in the central region of one or both end panel(s) 22. The spacing at the first end 42 of the spiral waveguide 40 is sized to correspond with the surface area of the diaphragm of the low-frequency speaker 33. The internal distance between end panels 22, 23 is equal to +/−20% of the diameter of the piston of the low-frequency speaker 33 to avoid an excessively elongated slot-shaped terminus, since sound waves are spherical in nature.

Figure 6:
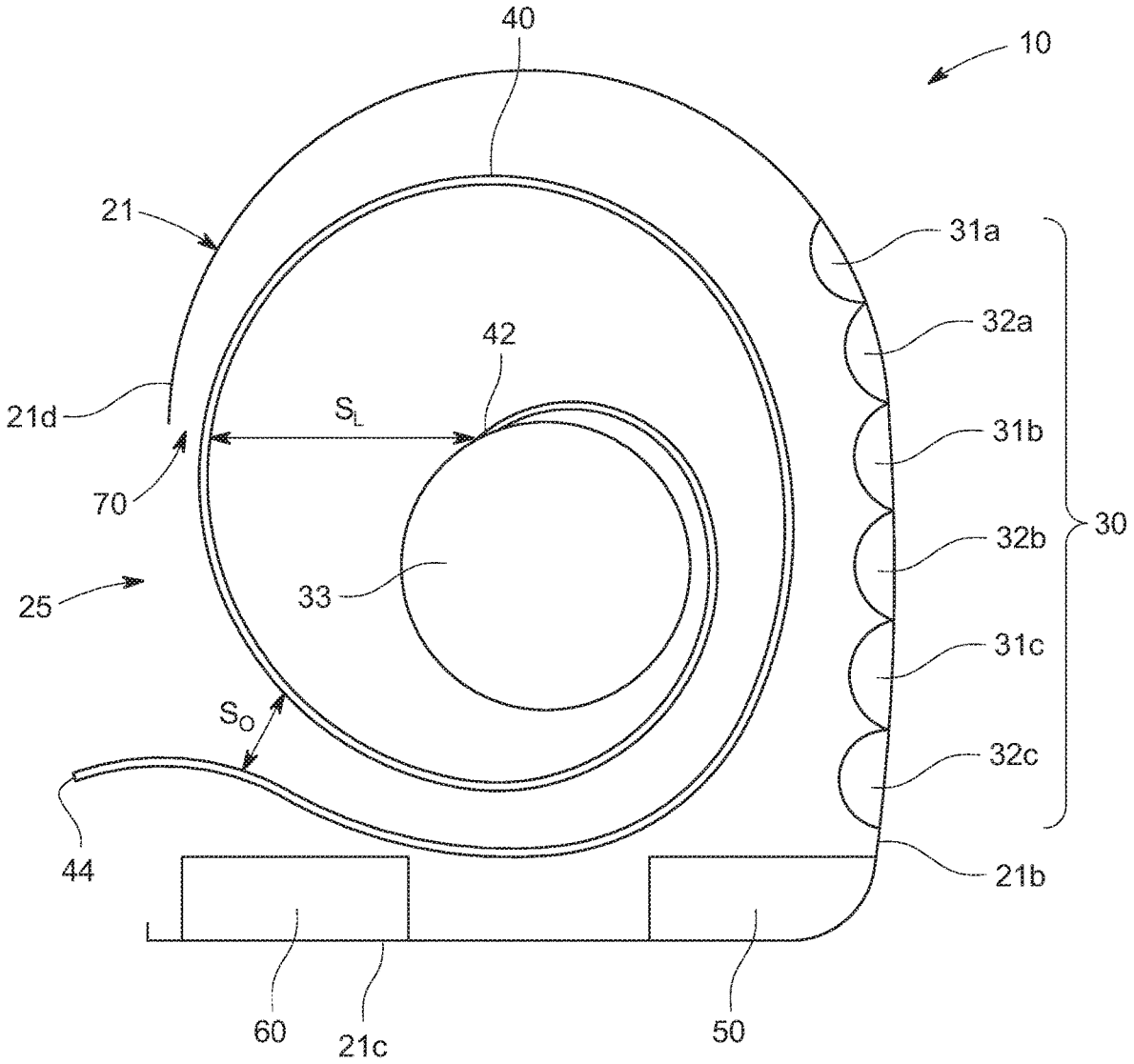
FIG. 6 is a side sectional view of the speaker system shown in FIG. 1.

The speaker system 10 may further be provided with an amplifier and/or sound processing unit 50 located within the housing 20 for powering the speakers 31*a*, 31*b*, 31*c*, 32*a*, 32*b*, 32*c*, 33. A power supply, such as a battery 60 may also be provided which renders the speaker system portable. Further, as shown in FIG. 6, there may exist a vent 70 between the sidewall 21 and spiral waveguide 40 at the upper end of the exit port 25. The side wall 21 and end panels 22, 23 may be formed from thinner, light-weight materials such as polycarbonate or HDPE since the internal structure of the speaker system 10 impedes radial vibrations.

The spiral waveguide 40 starts out with a relatively wide area $S_L$ between the first end 42 and the next winding, but narrows as the winding of the waveguide 40 progress such that there is a relatively narrow area $S_O$ at the point near the second end 44 where the waveguide begins to flare outward. Due to the upward angle of the flared terminus, the back of the enclosure can be placed directly against a wall without adverse effects. The high taper ratio $S_L/S_O$ of the spiral waveguide 40 pushes the undesirable first overtone out of the operating range of the low-frequency speaker 33 and also increases the effective length. The high taper ratio also means that the smaller cross-sectional area $S_O$ before the flared terminus must be 6-15 times smaller in cross-sectional area than the larger cross-sectional area $S_L$ at the first end 42 of the waveguide 40. The increased effective length allows below FS tuning and elimination of the hump in the combined response when using woofers with a Qts>0.4.

Figure 7:
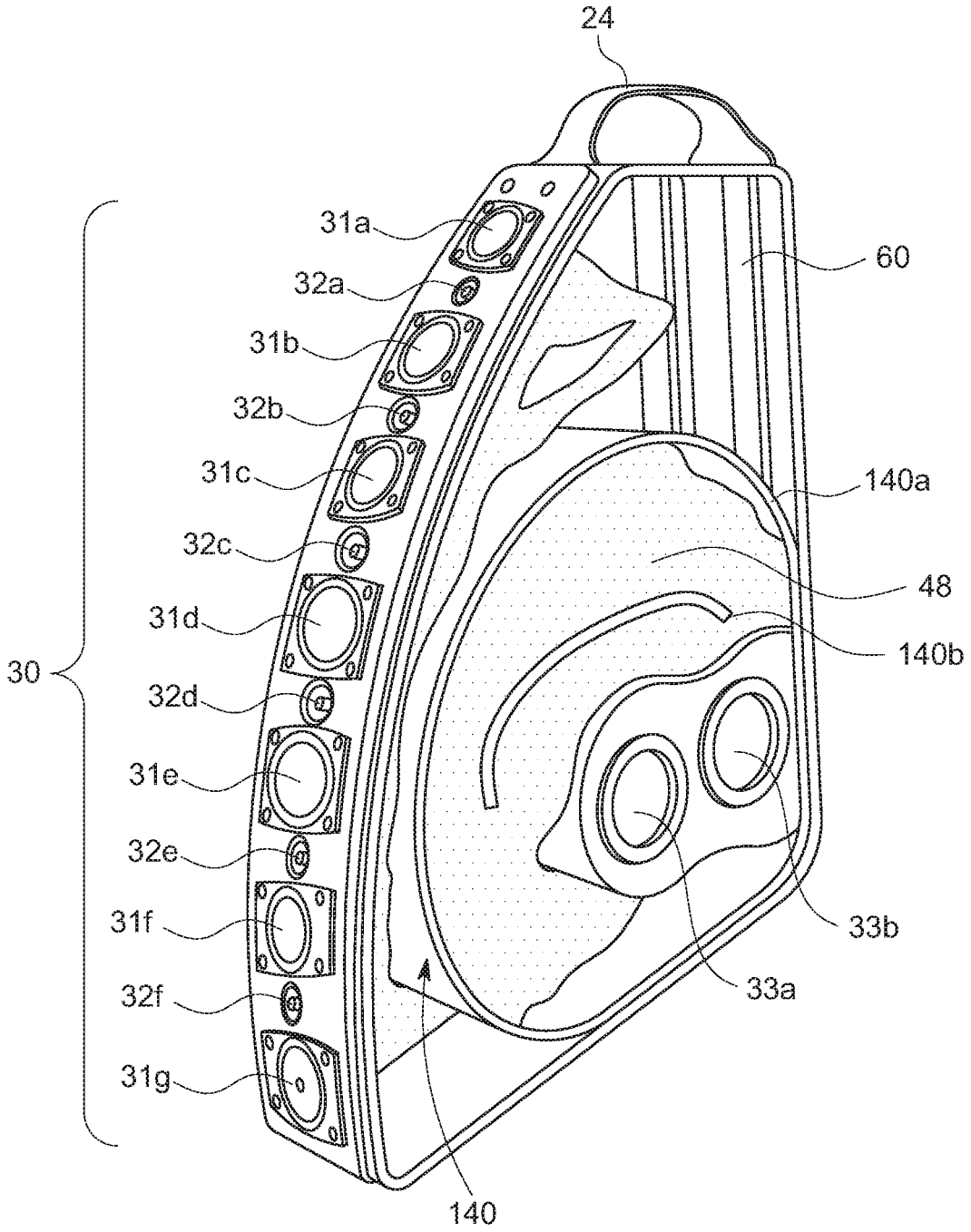
FIG. 7 is a perspective view of a speaker system having a low-frequency spiral waveguide according to an alternative preferred embodiment of the invention.
Figure 8:
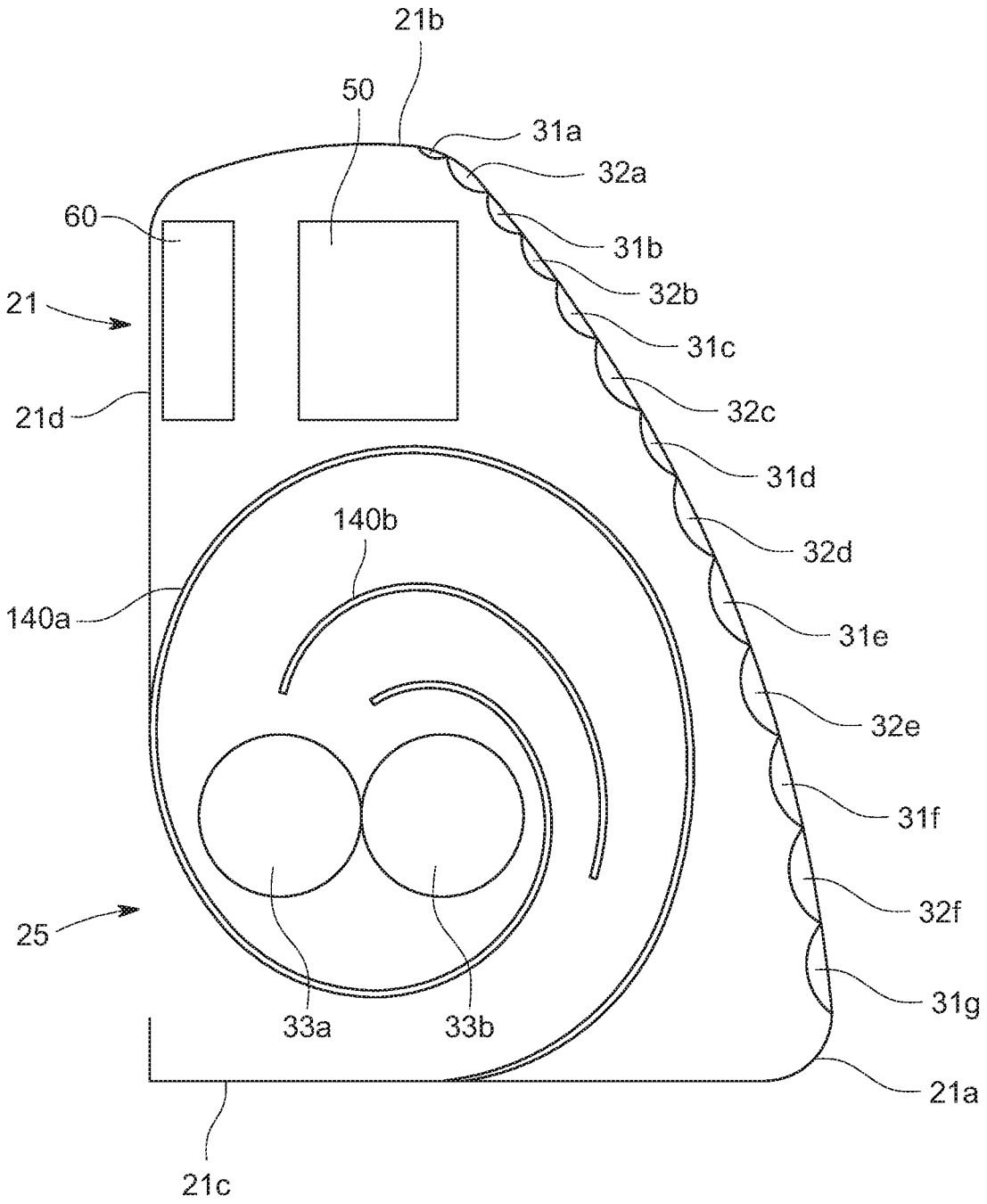
FIG. 8 is a side sectional view of the speaker system shown in FIG. 7.

FIG. 7-FIG. 8 show a speaker system 110 according to an alternative embodiment of the present invention. The speaker system 110 according to the alternative embodiment is similar to the speaker system 10 shown in FIG. 1-FIG. 6 to the extent that like reference numerals indicate like components. The speaker system 110 according to the alternative embodiment includes a few differences. First, more speakers 31*a*, 31*b*, 31*c*, 31*d*, 31*e*, 31*f*, 31*g*, 32*a*, 32*b*, 32*c*, 32*d*, 32*e*, 32*f* are provided as part of the front facing speaker array 30, and two low-frequency speakers 33*a*, 33*b* are provided in the center region of end panel 22. The most notable difference in this alternative embodiment is the presence of a twin-path spiral waveguide 140 which includes a full length primary spiral waveguide 140*a* and a shorter, secondary waveguide 140*b* that is interposed between windings of the primary spiral 140*a*. The use of such a twin-path spiral waveguide 140 reduces resonance in the end panel 22. The sound produced by such a speaker system 110 is suitable for larger gatherings.

Figure 9:
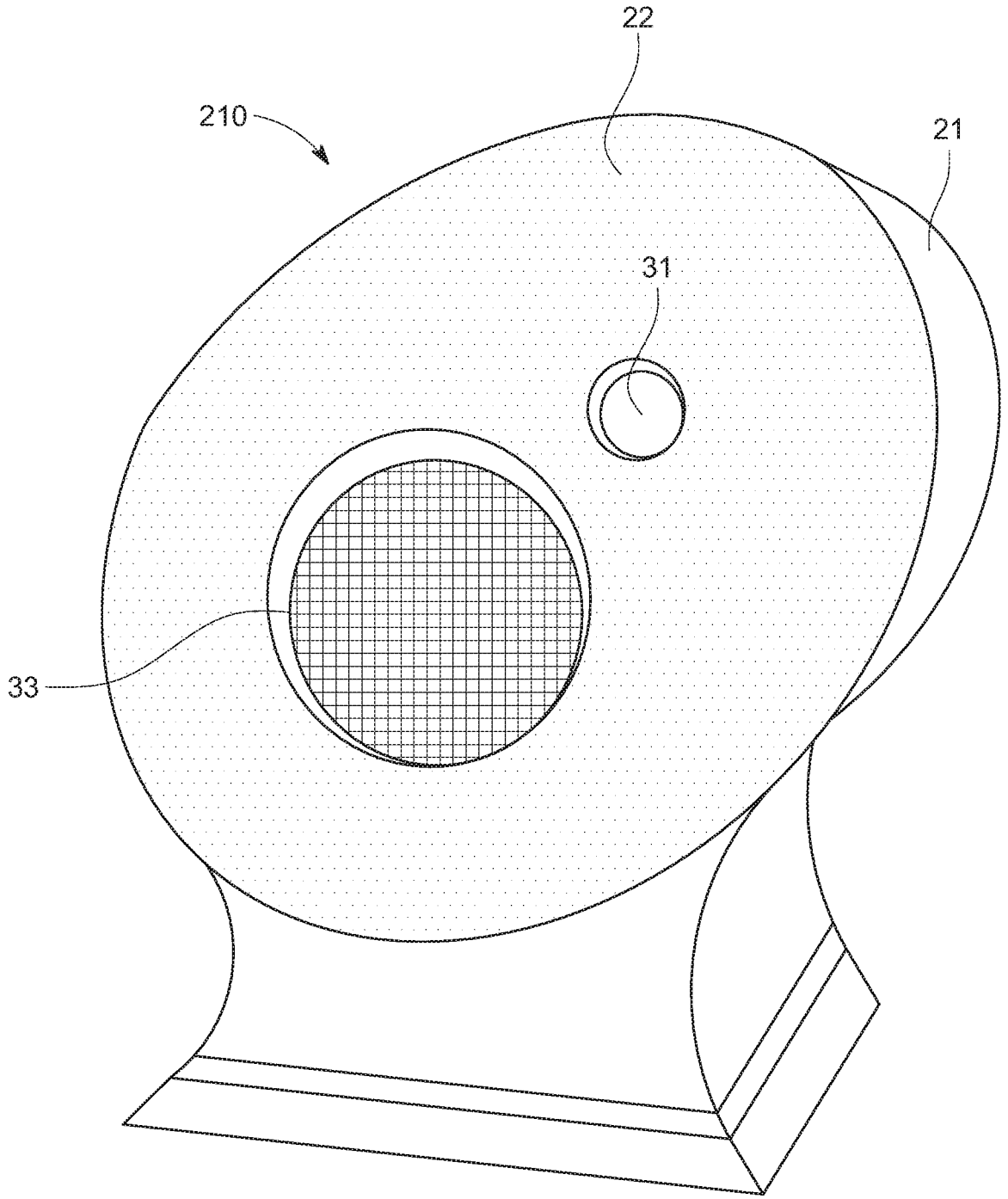
FIG. 9 is a top plan view of a two-box speaker system according to another embodiment of the invention.
Figure 10:
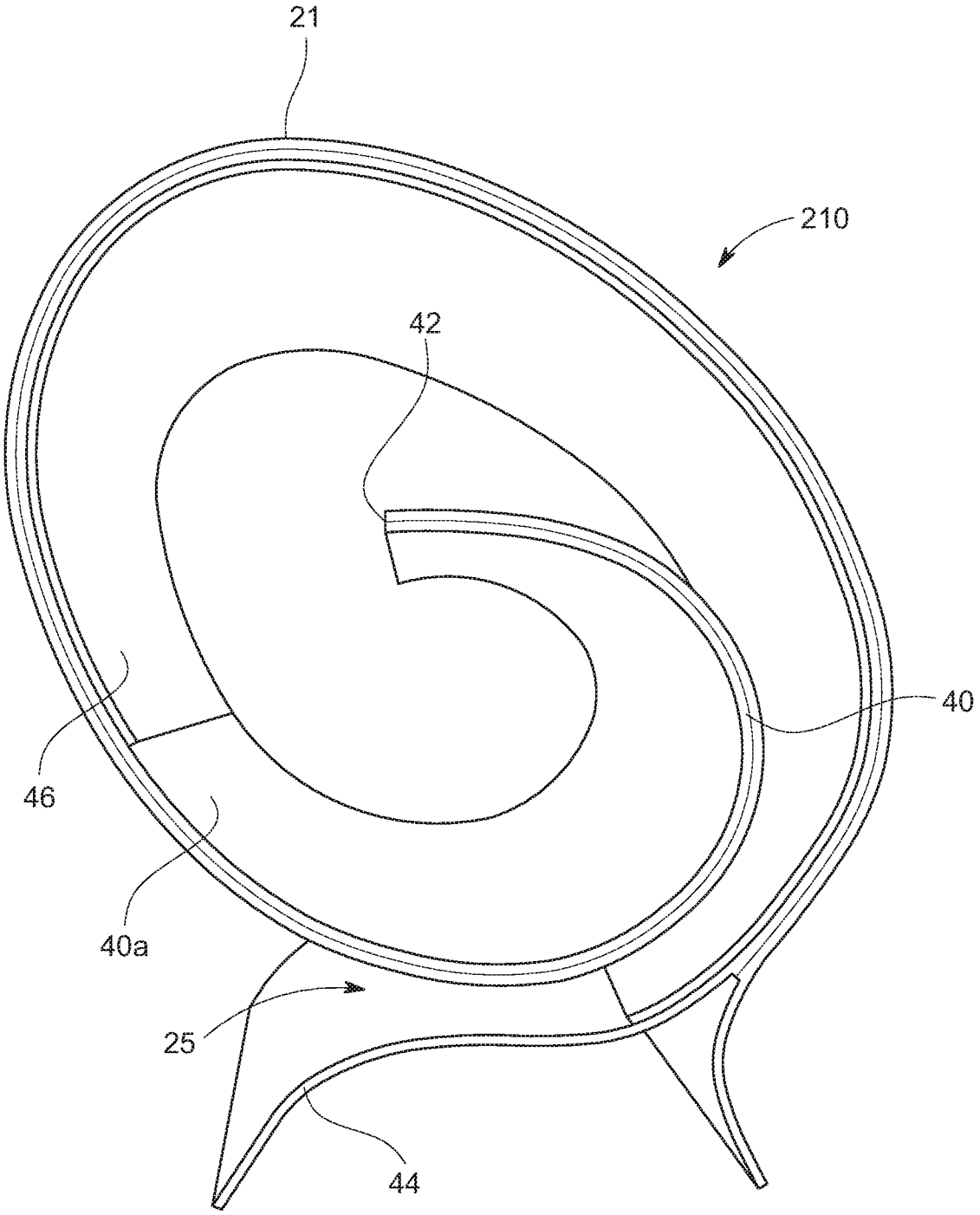
FIG. 10 is a cross section view of one of the box speakers shown in FIG. 9 along the line 10-10.

FIG. 9-FIG. 10 show a speaker system 210 according to a further alternative embodiment of the present invention. The speaker system 210 according to the alternative embodiment is similar to the speaker system 10 shown in FIG. 1-FIG. 6 to the extent that like reference numerals indicate like components. The speaker system 110 according to the alternative embodiment includes a few differences. First, the speaker system 210 is smaller and is designed to rest on a bookshelf and includes a single low-frequency speaker 33 and a single additional speaker 31. Both the additional speaker and low-frequency speaker 33 are located in a side panel 22, which in the case of this speaker system 210 is designed to face forward. The spiral waveguide 40 includes a first end 42 located near the center of the speaker system 210 and spirals outwardly to a second end 44 which, along with an interior portion of the waveguide wall, forms the low-frequency terminus exit port 25. Damping material 46, such as acoustical open cell foam rubber, may be applied to the inner surface 40*a* of the spiral waveguide 40 thereby adding to the effective length by increasing friction of the air mass in the sound wave. The spiral waveguide 40 also acts as the sidewall 21 of the speaker system 210. The speaker system 210 is substantially egg-shaped, which provides improved speaker performance. The speaker system 210 may further be tilted at approximately 45 degrees as shown in FIG. 9 and FIG. 10 which results in a longer waveguide 40 thereby reducing the tuning frequency which also improved speaker performance.

Figure 11:
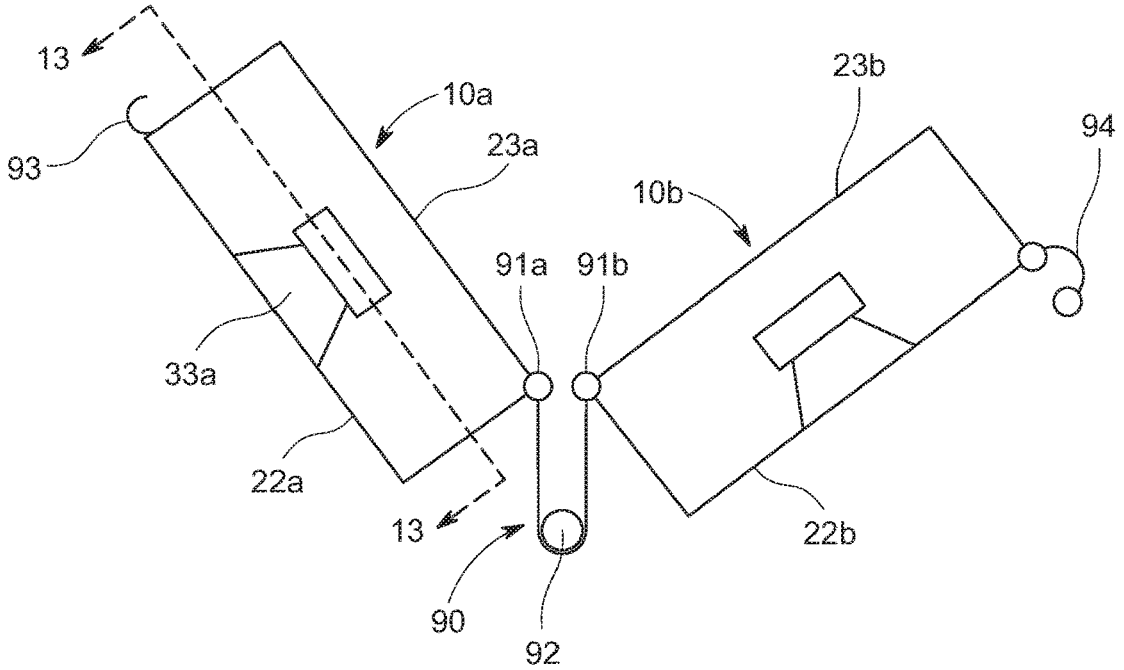
FIG. 11 is a perspective view of a speaker system having a low-frequency spiral waveguide according to a further alternative preferred embodiment of the invention.
Figure 12:
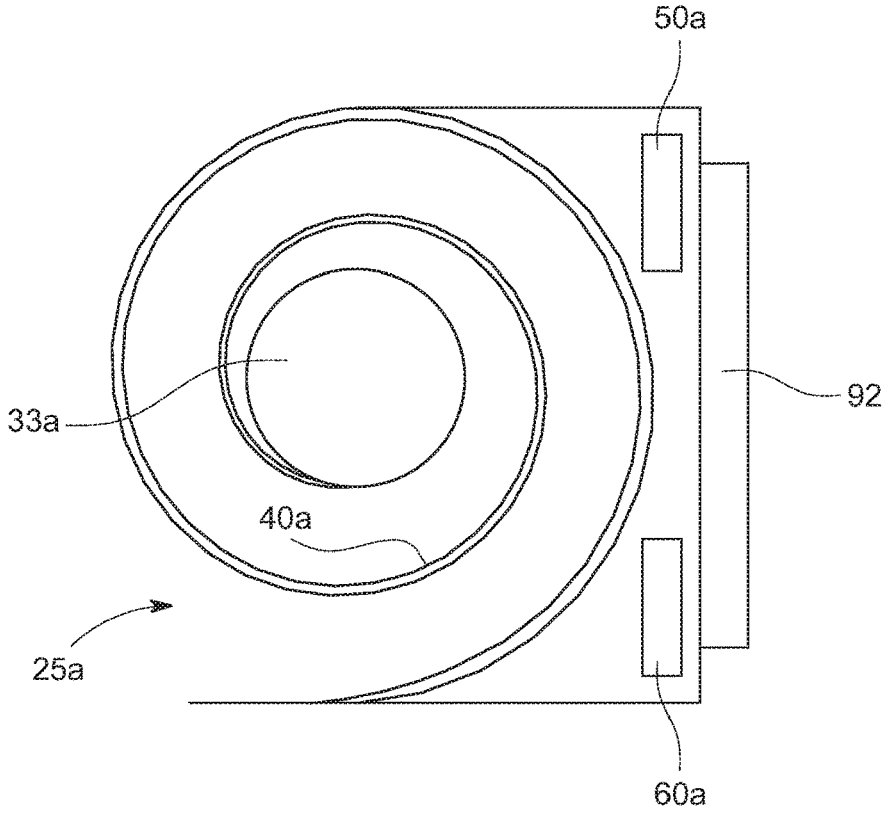
FIG. 12 is a side sectional view of the speaker system shown in FIG. 12.

FIG. 11 and FIG. 12 show a pair of speaker systems 10*a*, 10*b* connected to one another by a tri-fold hinge 90 in a butterfly configuration. The internal components of each speaker system 10*a*, 10*b* are similar to the previous embodiments where like reference numerals indicate like components. The tri-fold hinge 90 is attached to each speaker system 10*a*, 10*b* at pivot points 91*a*, 91*b*, respectively. By rotating the speaker systems 10*a*, 10*b* about their respective pivot points 91*a*, 91*b*, the speaker systems 10*a*, 10*b* can be oriented at any angle between 0 and 180 degrees relative to one another, including the approximate 90 degree orientation shown in FIG. 11. Once the speaker systems 10*a*, 10*b* are oriented in the in-line (180 degrees) position, the speaker systems 10*a*, 10*b* may then be rotated about the pole socket hinge pivot 92 bringing the end panels 22*a*, 22*b* into contact with one another for easy transporting. A hook 93 and latch 94 may be provided to secure the two speaker systems 10*a*, 10*b* together for transporting.

The principles of the speaker system 10 of the present invention apply to all variations of the low-frequency spiral waveguide, including active and/or passive, dual-opposed, twin-path, dual-density, and all other variants that employ additional cavities around its main internal structure. This detailed description, and particularly the specific details of the exemplary embodiment disclosed, is given primarily for clearness of understanding and no unnecessary limitations are to be understood therefrom, for modifications will become evident to those skilled in the art upon reading this disclosure and may be made without departing from the spirit or scope of the claimed invention.

The invention claimed is:

1. A low-frequency loudspeaker comprising:

an enclosure having a front, a back and a sidewall;

an audio speaker mounted in an opening in the front of the enclosure, said audio speaker having a diaphragm for producing front sound waves that are transmitted outwardly from the diaphragm and back sound waves that are transmitted into the enclosure from the diaphragm; and a spiral waveguide positioned within said enclosure, said spiral waveguide having a first end proximal to the speaker diaphragm for receiving said back sound waves, said spiral waveguide extending outwardly therefrom in a spiral pattern to a second end that forms a low-frequency terminus exit port opening in said sidewall; wherein the spiral waveguide begins with a relatively wide area between the first end and the next winding and narrows as the winding of the waveguide progresses such that there is a relatively narrow area at the exit port.

2. The low-frequency loudspeaker according to claim 1 further comprising one or more speakers mounted in a corresponding one or more openings in a front-facing section of said sidewall.

3. The low-frequency loudspeaker according to claim 2 wherein said one or more speakers comprises a plurality of speakers.

4. The low frequency loudspeaker according to claim 2 wherein said low-frequency terminus exit port is located in a rear-facing section of said sidewall.

5. The low frequency loudspeaker according to claim 1 wherein said low-frequency terminus exit port is flared to provide a smooth transition from high pressure sound waves to a listening room at a dissimilar acoustic impedance.

6. A low-frequency loudspeaker according to claim 1, wherein spiral waveguide extends from and ties together the front and back of the enclosure to control undesirable large panel resonances caused by excitation pressure within.

7. A low-frequency loudspeaker comprising: an enclosure having a front, a back and a sidewall:

an audio speaker mounted in an opening in the front of the enclosure, said audio speaker having a diaphragm for producing front sound waves that are transmitted outwardly from the diaphragm and back sound waves that are transmitted into the enclosure from the diaphragm; and a spiral waveguide positioned within said enclosure, said spiral waveguide having a first end proximal to the speaker diaphragm for receiving said back sound waves, said spiral waveguide extending outwardly therefrom in a spiral pattern to a second end that forms a low-frequency terminus exit port opening in said sidewall; and fibrous damping material located in the enclosure to provide acoustic viscosity which helps control infrasonic cone motion and further increases the effective length of the waveguide, further including damping material applied to an outer face of the spiral.

8. The low-frequency loudspeaker according to claim 1, wherein the spacing at the first end of the spiral waveguide is sized to correspond with the surface area of the diaphragm of the low-frequency speaker.

9. The low-frequency loudspeaker according to claim 8, wherein the internal distance between the front and back of the enclosure is equal to +/−20% of the diameter of a piston of the low-frequency speaker.

10. The low-frequency loudspeaker according to claim 1, wherein said audio speaker mounted in an opening in the front of the enclosure comprises a pair of audio speakers mounted adjacent to one another.

11. The low-frequency loudspeaker according to claim 10, wherein said spiral waveguide comprises a full length primary spiral waveguide and a shorter, secondary waveguide interposed between windings of the primary spiral waveguide.

12. The low-frequency loudspeaker according to claim 1, further comprising one or more speakers mounted in a corresponding one or more openings in the front of the speaker.

13. The low-frequency loudspeaker according to claim 12, wherein the spiral waveguide also acts as the sidewall of the enclosure.

14. The low-frequency loudspeaker according to claim 12, wherein the enclosure is substantially egg-shaped.

15. The low-frequency loudspeaker according to claim 14, wherein the egg-shaped enclosure in offset from an upright position resulting in a longer waveguide thereby reducing the tuning frequency which also improved speaker performance.

16. The low-frequency loudspeaker according to claim 15, wherein the egg-shaped enclosure is offset by 45 degrees.

* * * * *